US008082975B2

(12) United States Patent
Ide et al.

(10) Patent No.: US 8,082,975 B2
(45) Date of Patent: Dec. 27, 2011

(54) APPARATUS AND METHOD FOR PRODUCING CASTING MOLD

(75) Inventors: Isamu Ide, Sakai (JP); Sadao Maeda, Okazaki (JP)

(73) Assignee: Lignyte Co., Ltd., Sakai-shi (JP)

( * ) Notice: Subject to any disclaimer, the term of this patent is extended or adjusted under 35 U.S.C. 154(b) by 399 days.

(21) Appl. No.: 12/227,347

(22) PCT Filed: Apr. 27, 2007

(86) PCT No.: PCT/JP2007/059233

§ 371 (c)(1),
(2), (4) Date: Nov. 14, 2008

(87) PCT Pub. No.: WO2007/132669

PCT Pub. Date: Nov. 22, 2007

(65) Prior Publication Data

US 2009/0236070 A1 Sep. 24, 2009

(30) Foreign Application Priority Data

May 16, 2006 (JP) ..... 2006-136842

(51) Int. Cl.
*B22C 9/12* (2006.01)

(52) U.S. Cl. ..... 164/159; 164/12; 164/16

(58) Field of Classification Search ..... 164/12, 164/16, 159, 165–166, 200–202
See application file for complete search history.

(56) References Cited

U.S. PATENT DOCUMENTS 4,232,726 A * 11/1980 Michelson ..... 164/12
7,784,524 B2 * 8/2010 Ide et al. ..... 164/16

FOREIGN PATENT DOCUMENTS

JP 62-176634 8/1987
JP 2000-84641 3/2000
JP 2000-107835 4/2000

OTHER PUBLICATIONS

International Search Report, Sep. 4, 2007, issued in PCT/JP2007/059233.

* cited by examiner

*Primary Examiner* — Kuang Lin
(74) *Attorney, Agent, or Firm* — Edwards Wildman Palmer LLP

(57) ABSTRACT

To provide a casting mold manufacturing apparatus using steam heating. The apparatus includes a forming die having a cavity, a resin-coated sand supply section for supplying a resin-coated sand into the cavity, a steam supply section for supplying steam into the cavity, and a steam discharge section for discharging the steam from the cavity. At least a portion of the forming die is composed of a porous material having pores with an average diameter smaller than an average particle diameter of the resin-coated sand. At least a portion of the steam is supplied into the cavity through the porous material. Since it is possible to uniformly supply the steam into the cavity, a homogeneous casting mold can be manufactured.

15 Claims, 6 Drawing Sheets

(A)

(B)

(A)

(B)

APPARATUS AND METHOD FOR PRODUCING CASTING MOLD

TECHNICAL FIELD

The present invention relates to an apparatus and a method for manufacturing a mold for use in casting.

BACKGROUND ART

A conventionally known method for manufacturing a casting mold using a resin-coated sand, which is prepared by coating a refractory aggregate with a binder such as a heat-curable resin, is a method in which the resin-coated sand is supplied into a cavity of a heated die, the binder is cured by the heat of the die, and the refractory aggregate is bound with the cured binder, whereby the casting mold is manufactured.

With this method, it is possible to manufacture a casting mold having a stable quality with high productivity. However, since the die needs to be heated to a high temperature, the heat-curable resin such as a phenolic resin, which is used as a binder of the resin-coated sand, reacts chemically, and consequently a problem is caused in that toxic substances such as ammonia and formaldehyde are generated, which leads to deterioration in working environment. Further, since a portion of the resin-coated sand, the portion being in contact with the die, is heated rapidly, the manufactured casting mold is likely to suffer distortion such as warpage.

In order to solve these problems, disclosed in Japanese Patent No. 3563973 is a method for manufacturing a casting mold by filling the resin-coated sand inside a die, and blowing steam inside the die, whereby the resin-coated sand inside the die is heated with the steam and a binder therein is cured. In the method, since the resin-coated sand is heated with the heat of the steam, it is possible to prevent the toxic substances from being generated from the resin-coated sand when the same is in contact with the hot die.

However, the steam is supplied into the die through one or, at most, several injection holes arranged in the die. Therefore, if a shape of the casting mold is increasingly complicated, it becomes increasing difficult to allow the steam to be distributed over the entirety of the resin-coated sand filled in the die. Therefore, this technique for manufacturing a casting mold still needs to be improved in order to uniformly heat the entirety of the resin-coated sand filled in the die.

DISCLOSURE OF THE INVENTION

The present invention has been invented in view of the above-described problems, and an object of present invention is to provide a casting-mold manufacturing apparatus which is capable of manufacturing a casting mold composed of a homogeneous resin-coated sand by uniformly heating the entirety of the same with steam.

That is, a casting mold manufacturing apparatus comprises: a forming die having a cavity; a resin-coated sand supply section for supplying a resin-coated sand into the cavity, the resin-coated sand being made by coating a refractory aggregate with a binder resin; a steam supply section for supplying steam into the cavity; and a steam discharge section for discharging the steam from the cavity. At least a portion of the forming die is composed of a porous material having pores with an average diameter smaller than an average particle diameter of the resin-coated sand such that the steam is supplied into the cavity through the porous material.

According to the present invention, a steam provided from the steam supply section can be directly supplied into the cavity from a steam injection hole and the like, and the steam can be also indirectly supplied into the cavity through the porous material composing the forming die. Accordingly, the steam can be distributed over the entirety of the resin-coated sand, and as a result it is possible to uniformly heat the resin-coated sand and also possible to manufacture a more homogeneous casting mold than before.

In the present invention, the steam supply section preferably supplies superheated steam into the cavity. As an example, it is preferable that superheated steam is supplied into the cavity at a temperature equal to or higher than a curing temperature of the resin-coated sand, at a steam pressure of 1.5 to 10 $Kgf/cm^2$.

Further, the technical idea of the present invention includes a configuration in which all the steam provided from the steam supply section is indirectly supplied into the cavity through the porous material of the forming die, instead of providing the steam injection hole to the forming die. Namely, in this case, it is preferable to use a chamber having an internal volume capable of accommodating the forming die and also having a steam supply port for causing the steam to be supplied thereinside from the steam supply section, and also preferable that the forming die is composed of the porous material such that the steam, which is supplied, through the steam supply port, into the chamber including therein the forming die, uniformly (substantially at a hydrostatic pressure) enters into the cavity from an area surrounding the forming die through the porous material.

Further, the forming die preferably includes: at least one first steam supply passage for directly supplying the steam into the cavity; and at least one second steam supply passage for indirectly supplying the steam into the cavity through the porous material. It is particularly preferable that the second steam supply passage branches off from the first steam supply passage.

Further, in the case where the forming die is composed of the porous material, the forming die preferably has a shield layer on an outside surface thereof so as to prevent the steam from leaking outside through the porous material. Accordingly, it is possible to efficiently supply the steam, which is provided from the steam supply section, into the cavity through the porous material without losing a portion of the steam. For a similar reason, in the case where the steam discharge passage for discharging the steam from the cavity is provided in the forming die composed of the porous material, a shield layer is preferably provided on an inner surface of the steam discharge passage so as to prevent the steam from directly entering into the steam discharge passage through the porous material instead of from the cavity.

Another purpose of the present invention is to provide a casting mold manufacturing method in accordance with a technical idea similar to that of the casting mold manufacturing apparatus. The manufacturing method includes the steps of: preparing a forming die having a cavity thereinside; filling the cavity with a resin-coated sand which is made by coating a refractory aggregate with a binder resin; supplying the steam into the cavity and curing the binder resin included in the resin-coated sand; and discharging the steam from the cavity. At least a portion of the forming die is composed of a porous material having pores with an average diameter smaller than an average particle diameter of the resin-coated sand, and at least a portion of the steam is supplied into the cavity through the porous material.

These and other features and advantages of the present invention will become more apparent from the following best mode for carrying out the present invention and examples.

BEST MODE FOR CARRYING OUT THE INVENTION

Hereinafter, a casting mold manufacturing apparatus and a casting mold manufacturing method according to the present invention will be described in detail with reference to preferred embodiments shown in drawings attached hereto.

Figure 1:
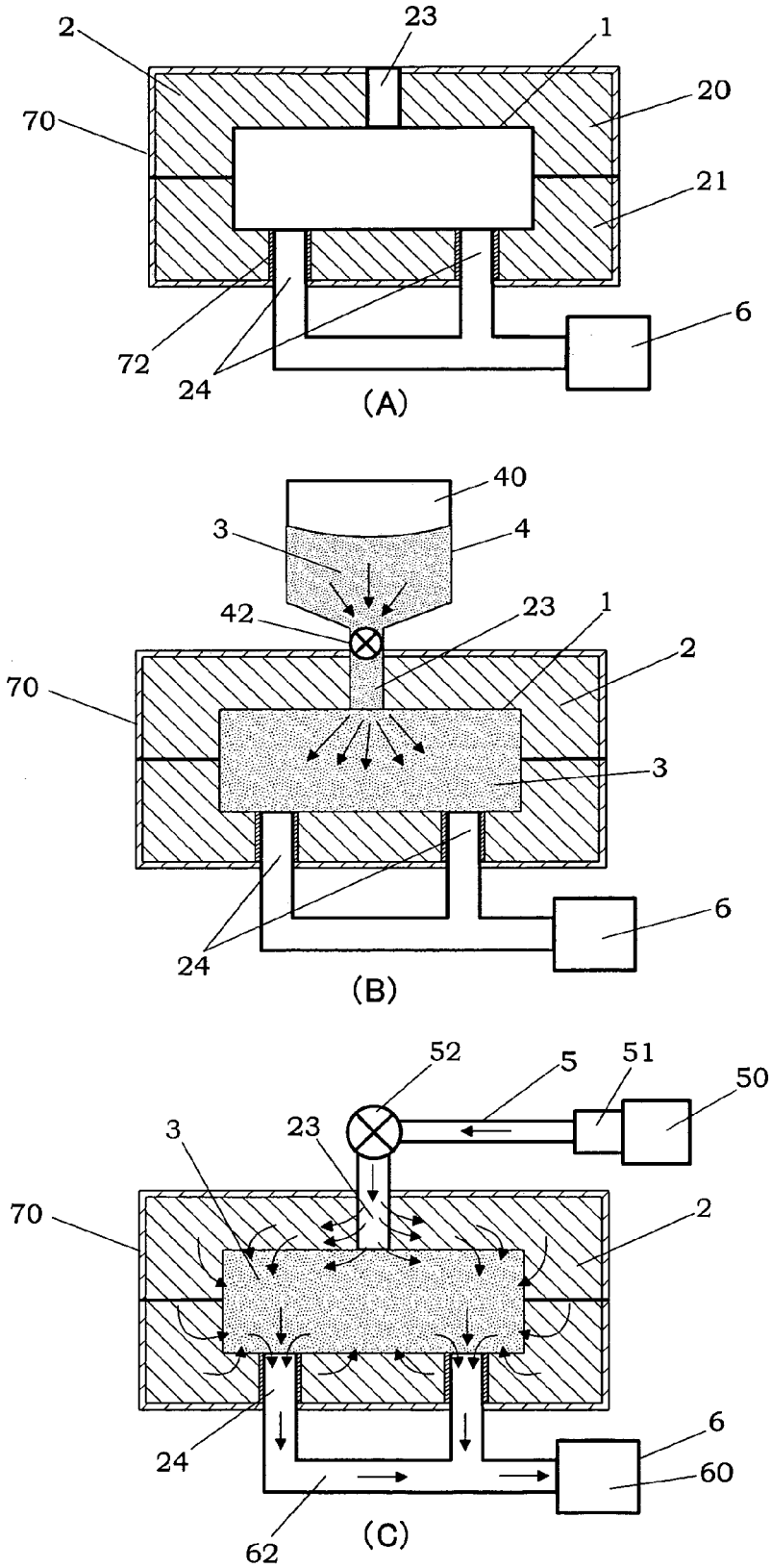
FIGS. 1(A), 1(B), and 1(C) are each a cross-sectional view showing an operation of a casting mold manufacturing apparatus according to a preferred embodiment of the present invention.

As shown in FIGS. 1(A) to (C), the casting mold manufacturing apparatus according to the present embodiment mainly includes a forming die 2 having a cavity 1, a resin-coated sand supply section 4 for supplying resin-coated sand 3 into the cavity 1, the resin-coated sand 3 being made by coating a refractory aggregate with a binder resin, a steam supply section 5 for supplying steam into the cavity 1, and a steam discharge section 6 for discharging the steam from the cavity.

The forming die 2 of the present embodiment is formed with a pair of split molds (20, 21), and when the split molds are coupled with each other, the cavity 1 is formed thereinside. The forming die 2 has an injection hole 23 which is connected to the steam supply section 5 and is designed to supply the steam into the cavity, and discharge holes 24 which are connected to the steam discharge section 6 and are designed to discharge the steam from the cavity 1. The injection hole 23 may be connected to the resin-coated sand supply section 4, when the same is not connected to steam supply section 5. The resin-coated sand 3 is supplied into the cavity 1 from the injection hole 23. In the vicinity of openings of the discharge holes 24 on the cavity side, nets or the like (not shown) are provided, through which the resin-coated sand 3 cannot pass but the steam can pass. Positions and numbers of the injection hole 23 and the discharge holes 24 are determined, respectively, in accordance with a shape of the cavity.

The forming die 2 is formed of a porous material such as sintered metal or sintered ceramic, which is made porous by sintering metal powder and ceramic powder, and has a series of micro pores which are capable of allowing the steam to pass through. The series of micro pores of the porous material are open on an entire surface facing the cavity 1 and on an inner surface of the injection hole 23.

The porous material forming the forming die 2 has pores with an average pore diameter smaller than an average particle diameter of the resin-coated sand 3 supplied into the cavity 1. Further, in view of a uniform supply of the steam and surface roughness of the casting mold to be obtained, porosity of the porous material is, not particularly limited, but preferably in a range of 5% to 75%, more preferably in a range of 10% to 65%.

An entire outside surface of the forming die 2 is coated with a shield 70 so as to prevent the steam from leaking outside. The shield 70 may be formed by attaching a plate material or the like, which is impermeable to the steam, onto the outside surface of the forming die 2. Alternatively, a close-grained skin layer may be provided on an entire outside surface layer of the forming die 2. Further, in order to prevent the steam from directly entering into the discharge holes 24 through the porous material, instead of from the cavity 1, a shield layer 72 is provided on an inner surface of each of the discharge hole 24.

As shown in FIG. 1(B), the resin-coated sand supply section 4 has a hopper 40 in which the resin-coated sand 3 is stored, and a shutter 42 which is provided at a bottom edge portion of the hopper 40. When the shutter 42 is opened, the resin-coated sand 3 is supplied into the cavity 1 through the injection hole 23.

The resin-coated sand 3 is prepared by mixing a refractory aggregate such as silica sand with a binder such as a heat-curable resin, and by coating a surface of the refractory aggregate with the binder. Used as the heat-curable resin are, for example, a phenolic resin, a furan resin, an isocyanate compound, an amine-polyol resin, a polyether polyol resin, and the like. The average particle diameter of the resin-coated sand is about 400 to 600 μm (e.g., 450 μm) in the case of a coarse particle, and is about 100 to 300 μm (e.g., 150 μm) in the case of a fine particle. It is noted that, as above described, the average pore diameter of the porous material composing the forming die 2 may be determined so as to be smaller than the average particle diameter of the resin-coated sand. Accordingly, in order to uniformly supply the steam into the cavity and to obtain a preferable casting mold surface, the porous material having the average pore diameter ranging from 30 to 100 μm, for example, is preferably, but not limitedly, used.

As shown in FIG. 1(C), the steam supply section 5 is, for example, composed of a steam generator 50 and a heater 51. The steam generated by the steam generator 51 is heated by the heater 51, and then supplied into the cavity 1 through the injection hole 23. In FIG. 1(C), reference number 52 represents a valve for adjusting an amount of steam to be supplied.

As shown in FIG. 1(C), the steam discharge section 6 of the present embodiment has a suction pump 60, and the suction pump 60 is connected to the discharge holes 24 of the forming die 2 via the suction tube 62. The steam inside the cavity may be naturally discharged through the discharge holes 24. In this case, the steam discharge section 6 is composed of the discharge holes 24 provided to the forming die 2. Further, in the case of natural discharging, the steam supplied from the steam supply section 5 is distributed over the entirety of the forming die 2 which is formed of the porous material, penetrates into the resin-coated sand 3 in the cavity 1 via the porous material, and is then discharged outside the forming die through the discharge holes 24 in a slow manner. Therefore, as shown in FIG. 1(C), it is possible to effectively supply the steam into the cavity, compared to a case where the steam is supplied from a lower side of the forming die 2.

Further, it is preferable that the discharge hole 24 has discharge amount adjusting means for adjusting an amount of steam to be discharged from the cavity and a temperature sensor for measuring a temperature of the steam discharged from the cavity, and that a control section controls the discharge amount adjusting means such that the temperature detected by the temperature sensor is maintained within a predetermined temperature range. In this case, it is possible to stably maintain the temperature inside the cavity so as to be equal to or higher than a curing temperature of the binder included in the resin-coated sand 3.

For convenience of explanation, FIG. 1(C) shows a cross-sectional view in which the steam supply section 5 is provided at an upper side of the forming die 2, and the steam discharge section 6 is provided at the lower side of the same. In order for the steam to travel for a longer distance, positions of the steam supply section 5 and the steam discharge section 6 may be displaced, respectively, in a direction perpendicular to the sheet of FIG. 1(C). Further, in FIG. 1(C), the steam supply section 5 is provided at the upper side of the forming die 2, and another steam supply section 5 may be additionally provided at the lower side of the forming die 2 so as to be distanced from the steam discharge section 6 in a direction perpendicular to the sheet of FIG. 1(C). Accordingly, the steam can be provided from the lower side of the forming die in the same manner as from the upper side, whereby the inside of the cavity 1 can be heated further uniformly.

According to the above-described apparatus, it is possible to manufacture a casting mold in a manner as described below. As shown in FIG. 1(B), the resin-coated sand supply section 4 is connected to the injection hole 23 of the forming die 2, and then the shutter 42 is opened, whereby the resin-coated sand 3 in the hopper 40 is filled into the cavity 1 of the forming die 2 through the injection hole 23. At this time, an inside of the hopper 40 is pressurized with a high-pressure air so as to inject the resin-coated sand 3 into the cavity 1, whereby the resin-coated sand 3 can be efficiently filled into the cavity 1.

After the resin-coated sand supply section 4 is removed from the injection hole 23 of the forming die 2, the steam supply section 5 is connected to the injection hole 23, as shown in FIG. 1(C), and the valve 52 is opened so as to supply the steam into the cavity 1. When the steam is supplied from the steam supply section 5, the steam discharge section 6 is actuated concurrently. Accordingly, the steam supplied into the cavity 1 passes among the particles of the resin-coated sand 3 in the cavity 1, and is then forcibly discharged from the discharge holes 24. Therefore, the steam will not stay among the particles of the resin-coated sand 3 filled in the cavity 1.

Further, when the steam passes through the injection hole 23, as indicated by arrows shown in FIG. 1(C), the steam penetrates from the inner surface of the injection hole 23 into the forming die 2 composed of the porous material. The steam then passes through the series of micro pores in the porous material, and flows into the cavity 1 from the surface facing the cavity 1. Therefore, the steam is supplied into the cavity 1 of the forming die 2 through the entire surface facing the cavity 1 as well as through the injection hole 23. Accordingly, the steam can be distributed over the entirety of the resin-coated sand 3 filled in the cavity 1, and thus the resin-coated sand 3 can be uniformly influenced by the steam.

The steam is heated by the heater 51 to a temperature equal to or higher than the curing temperature of the binder (heat-curable resin) included in the resin-coated sand 3, and then supplied to the forming die 2. For example, the steam having a temperature ranging from 110 to 180 degree Celsius and also having a steam pressure ranging from 0.15 to 1.0 MPa (1.5 to 10 kgf/cm$^2$) is preferably supplied. Further, saturated steam may be superheated by the heater 51 to a saturated temperature of around 200 to 600 degree Celsius or more to obtain superheated steam in a dry state, and resultant superheated steam is supplied to the forming die 2.

After the steam is supplied to cure the resin-coated sand 3, the steam supply section 5 is removed from the injection hole 23, and the forming die 2 is opened to extract the casting mold. In the case where the forming die 2 needs to be preheated, the steam is supplied to the forming die 2 as above-described, whereby the steam penetrates inside the forming die 2 composed of the porous material, and the entirety of the forming die 2 can be heated with the steam. Therefore, it is advantageous that a heating apparatus for heating the forming die 2 need not be provided individually.

If a plurality of cavities are provided in a single forming die 2 in order to form casting molds having various shapes or various sizes, and an amount of the steam supplied into each of the cavities can be adjusted at the steam supply section 5, then desired casting molds can be manufactured from the respective cavities concurrently. In this manner, it is possible to provide a casting mold manufacturing apparatus which is capable of manufacturing a wide variety of products in small quantities, which is one of the important features of the present invention.

Figure 2:
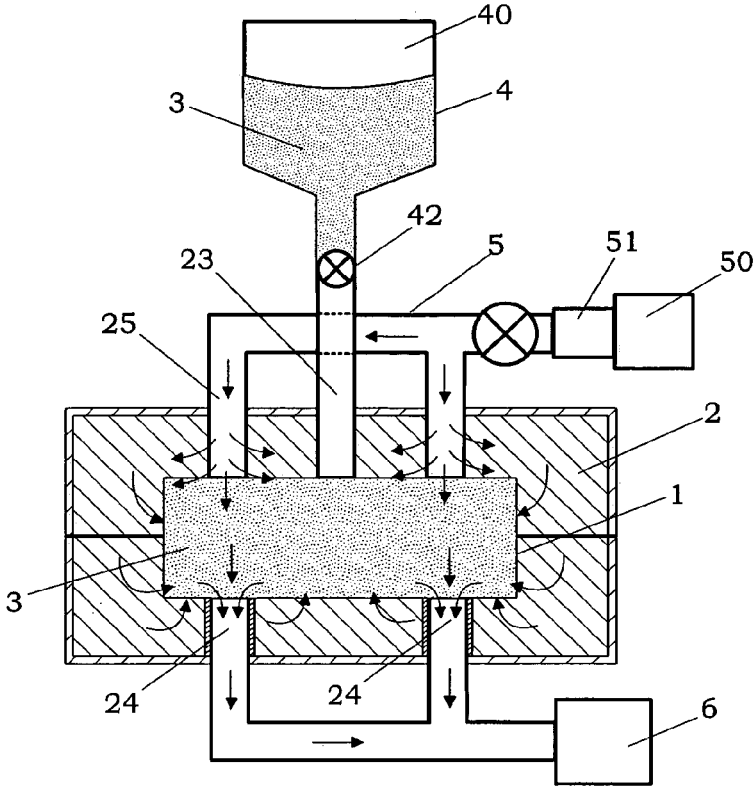
FIG. 2 is a cross-sectional view of a casting mold manufacturing apparatus according to another preferred embodiment of the present invention.

Further, as shown in FIG. 2, in addition to the injection hole 23 for supplying the resin-coated sand 3 into the cavity 1, a plurality of steam supply holes 25 for supplying the steam into the cavity 1 may be provided to the forming die 2. In such an apparatus, the resin-coated sand supply section 4 may be connected to the injection hole 23, and the steam supply holes 25 may be connected to the steam supply section 5 in a fixed manner, respectively. In FIG. 2, arrows indicate flows of the steam. The remaining configuration is substantially the same as those shown in FIGS. 1(A) to 1(C), and thus redundant description thereof will be omitted.

Figure 3:
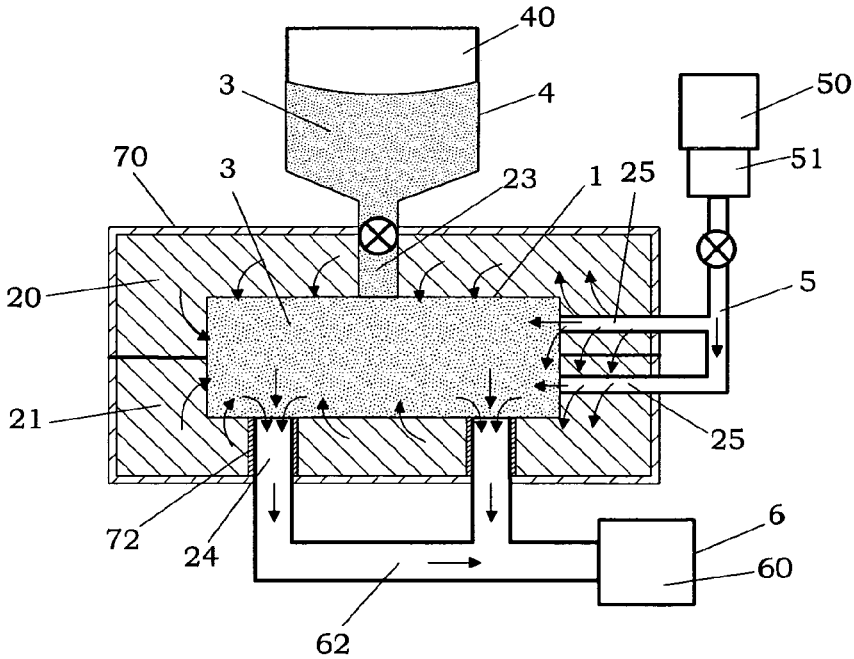
FIG. 3 is a cross-sectional view of a casting mold manufacturing apparatus according to still another preferred embodiment of the present invention.

Further, as shown in FIG. 3, the steam supply holes 25 may be provided to the respective split molds (20, 21) of the forming die such that the steam is supplied laterally into the cavity 1. According to such an apparatus, even in the case where it is difficult to distribute the steam to extremities of a laterally long cavity when the steam is supplied from the upper side only, it is possible to surely supply the steam from the side to the extremities of the cavity. Arrows shown in FIG. 3 indicate flows of the steam.

For convenience of explanation, FIG. 3 shows a cross-sectional view in which the steam supply section 5 is provided on the right side of the forming die 2, and the steam discharge section 6 is provided on the lower side. However, in order for the steam to travel for a longer distance, the positions of the steam supply section 5 and the steam discharge section 6 may be displaced, respectively, in a direction perpendicular to the sheet of FIG. 3. Further, in FIG. 3, the steam supply section 5 is provided on the right side of the forming die 2, and another steam supply section 5 may be additionally provided on the left side of the forming die 2. Accordingly, the steam may be supplied to the forming die from the right side as well as from the right side, and thus the inside of the cavity 1 can be heated further uniformly.

Figure 4:
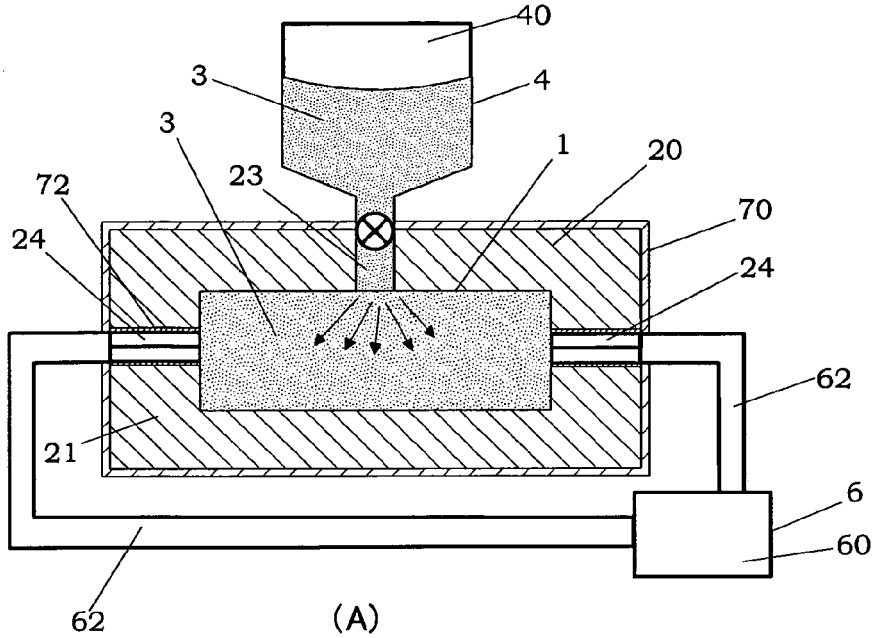
FIGS. 4(A) and 4(B) are each a cross-sectional view showing an operation of a casting mold manufacturing apparatus according to a further preferred embodiment of the present invention.
Figure 4:
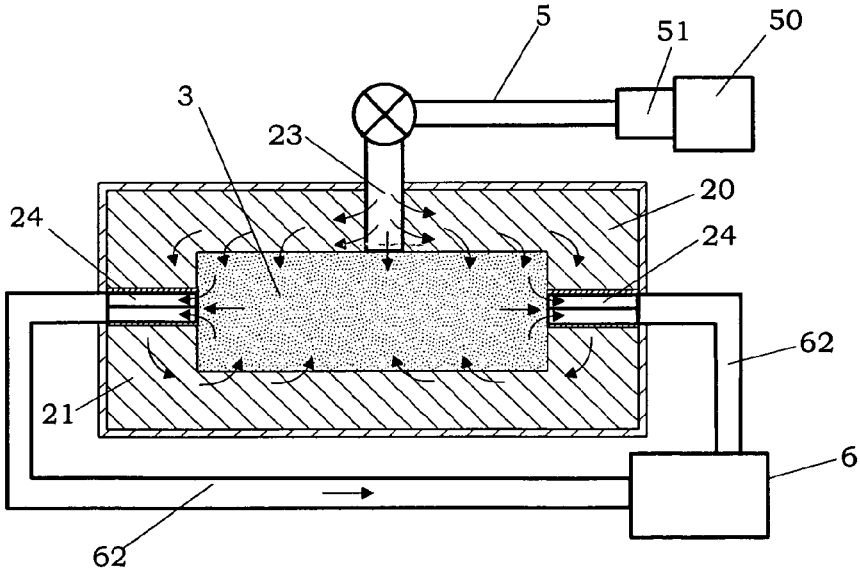

Further, as shown in FIGS. 4(A) and 4(B), the discharge holes 24, to which the suction tube 60 of the steam discharge section 6 is connected, may be formed between mating surfaces of the split molds (20, 21) of the forming die 2. In this manner, the discharge holes 24 are provided on both sides of the cavity 1, whereby the steam supplied into the cavity 1 through the injection hole 23 is dispersed throughout the resin-coated sand 3, and then travels toward the discharge holes 24. Accordingly, the steam travels smoothly inside the cavity, and consequently, it is possible to heat the inside of the cavity further uniformly. Further, maintenance of the forming die 2 can be performed easily, in the case of cleaning inside the discharge holes 24, for example. In such an apparatus, the injection hole 23 can be selectively connected to either the resin-coated sand supply section 4 or the steam supply section 5. In FIG. 4(B), arrows indicate flows of the steam.

Figure 5:
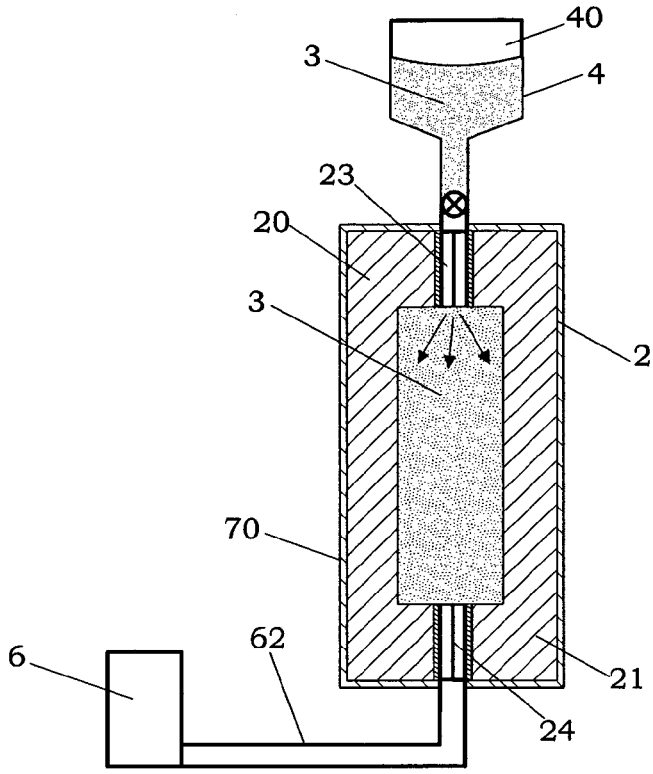
FIGS. 5(A) and 5(B) are each a cross-sectional view showing an operation of a casting mold manufacturing apparatus according to a modified example of the embodiment shown in FIG. 4.
Figure 5:
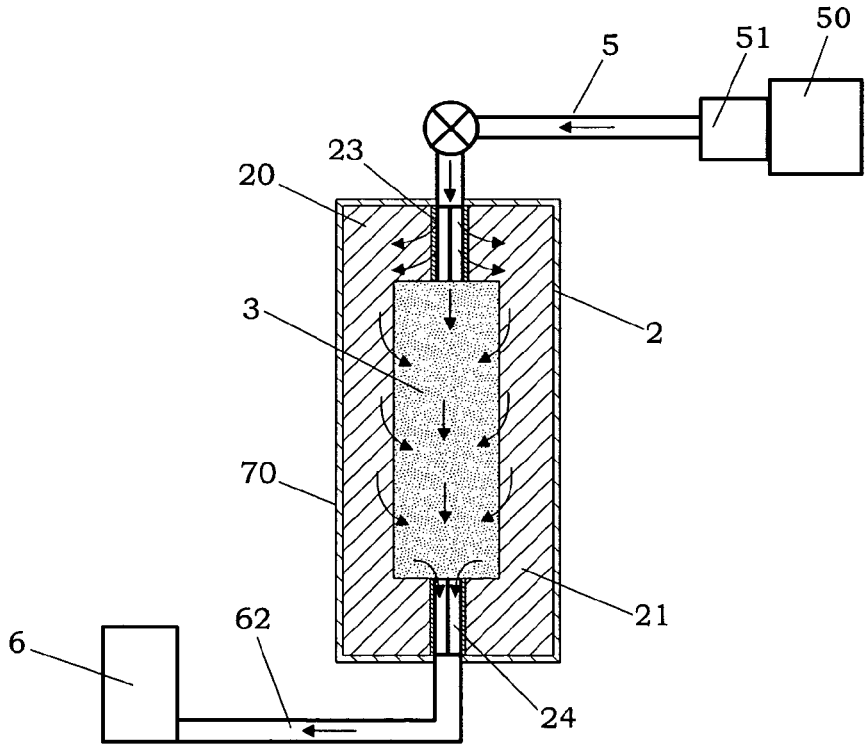

As shown in FIGS. 5(A) and 5(B), in accordance with a shape of the casting mold, the forming die 2 may be formed so as to be split in a vertical direction instead of a lateral direction. In this case, after the steam is supplied into the cavity 1, and the resin-coated sand 3 is heated and cured, the split molds (20, 21) are then split by moving the same in the left and right directions, respectively, whereby the casting mold can be easily extracted from the cavity. Further, due to an effect of gravity and suction discharge of the steam from the lower side of the cavity, flows of the steam from upside to downside are accelerated, and as shown with arrows in FIG. 5(B), it is possible to uniformly distribute the steam throughout the cavity.

Figure 6:
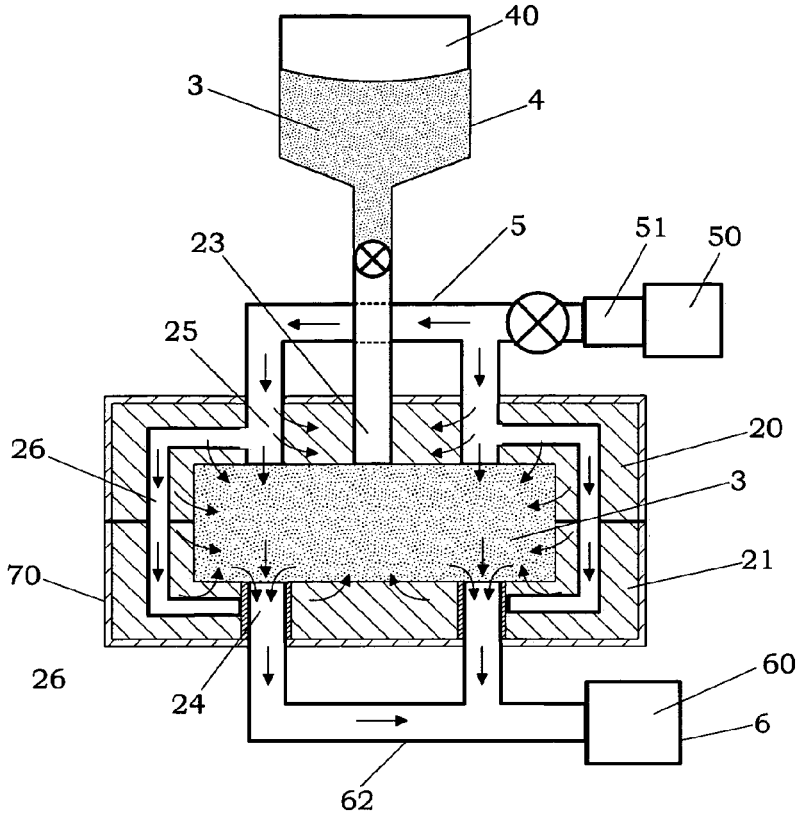
FIG. 6 is a cross-sectional view of a casting mold manufacturing apparatus according to a further preferred embodiment of the present invention.

Further, as shown in FIG. 6, it is also preferable that the forming die 2 has a plurality of steam supply holes 25 which are designed to directly supply the steam into the cavity 1, and steam supply passages 26 which branch off from the steam supply holes 25 and which are designed to indirectly supply the steam into the cavity 1 through the porous material. In this case, even when a casting mold having a complex shape is to be manufactured, it is possible to surely distribute the steam throughout the cavity. Arrows shown in FIG. 6 indicate flows of the steam. Since the configuration of the remaining component-parts is substantially the same as those of the above-described apparatuses, redundant description thereof will be omitted.

Figure 7:
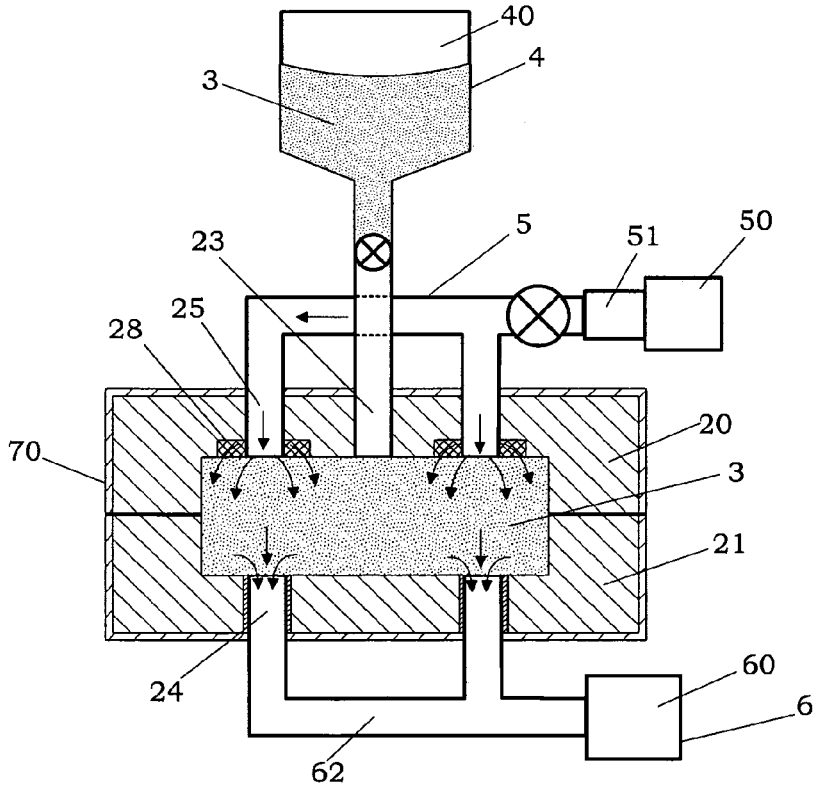
FIG. 7 is a cross-sectional view of a casting mold manufacturing apparatus according to another preferred embodiment of the present invention.

In the same manner as the above-described apparatuses, the entirety of the forming die 2 may be formed of the porous material. Alternatively, only a portion of the forming die 2, the portion facing the cavity 1 may be formed of the porous material. For example, as shown in FIG. 7, when porous portions 28 made of the porous material is arranged at such areas of the forming die that are adjacent to outlets of the steam supply holes 25 for supplying the steam into the cavity, and the areas that face both of the steam supply holes 25 and the cavity 1, then it is possible to supply the steam into the cavity not only from the steam supply holes 25 but also through the porous portions 28 adjacent to the outlets. Accordingly, an opening area of each of the steam supply holes 25 expands substantially, and thus it is possible to further uniformly heat the resin-coated sand 3 inside the cavity 1.

Figure 8:
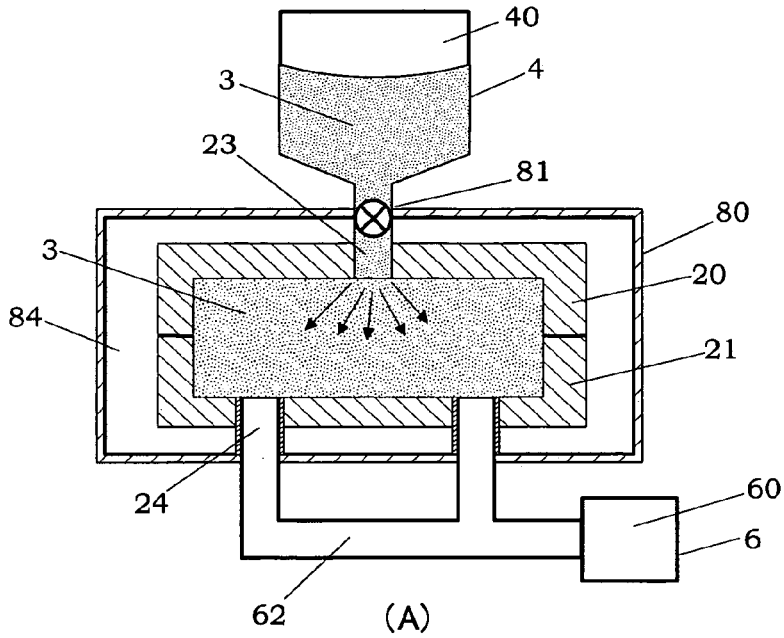
FIGS. 8(A) and 8(B) are each a cross-sectional view showing an operation of a casting mold manufacturing apparatus according to still another embodiment of the present invention.
Figure 8:
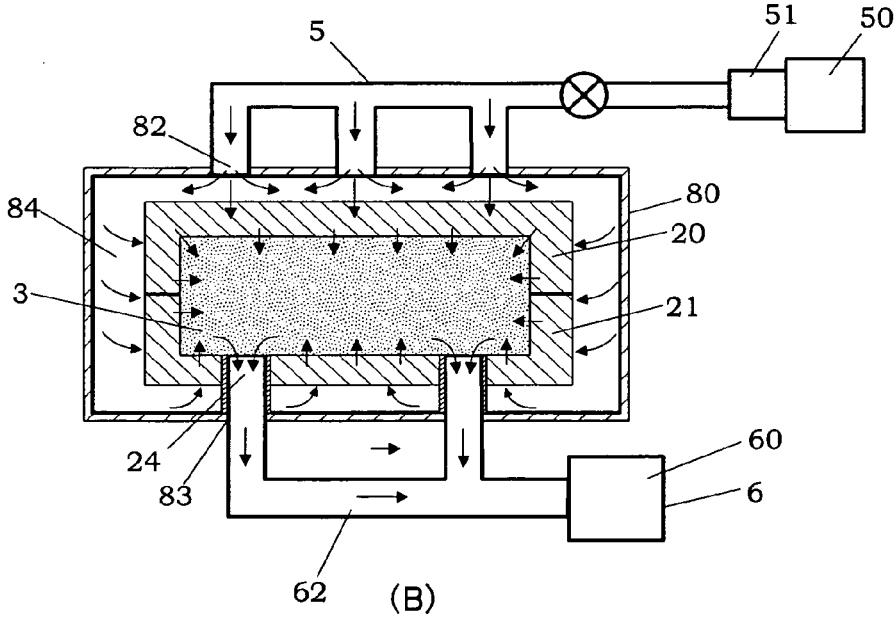

Further, instead of directly supplying the steam into the cavity 1 of the forming die 2, it may be possible to indirectly supply the steam into the cavity 1 from an area surrounding the forming die 2 through the porous material. For example, as shown in FIGS. 8(A) and 8(B), it is preferable that a casting mold is manufactured inside a chamber 80 having an internal volume capable of accommodating the forming die 2. The chamber 80 has a sand supply port 81 through which the resin-coated sand supply section 4 supplies the resin-coated sand 3 into the forming die 2, a steam supply port 82 through which the steam supply section 5 supplies the steam into the chamber, and steam discharge ports 83 for discharging the steam from the cavity. In this case, the steam supplied to a space 84 between the forming die 2 arranged inside the chamber 80 and an inner surface of the chamber 80 is uniformly (substantially at a hydrostatic pressure) supplied into the cavity 1 from the area surrounding the forming die 2 through the porous material. In the same manner as the above-described apparatuses, the steam supplied into the cavity 1 is discharged outside the chamber 80 through the discharge holes 24 and the steam discharge ports 83. Arrows shown in FIG. 8(B) indicate flows of the steam.

Next, the present invention will be explained further in detail in accordance with examples.

Manufacturing Example 1

The resin-coated sand 3 used in Examples 1 to 18 and Comparative examples 1 to 6 is prepared as described below. First, 30 kg of Flattery sand heated to 145 degree Celsius is poured in a whirl mixer, and 450 g of a resol-type phenolic resin (LT-15 made by Lignyte Co., Ltd.) is added thereto to be kneaded together for 30 seconds. 450 g of water is then added thereto to be further kneaded together thoroughly. After 30 g of calcium stearate is added thereto to be kneaded together for 30 seconds, aeration is performed to obtain the resin-coated sand 3 coated with the phenolic resin in a proportion of 1.5% by mass. An average particle diameter of the obtained resin-coated sand 3 is 160 μm.

Manufacturing Example 2

The resin-coated sand 3 used in Examples 19 to 21 is prepared in the same manner as Manufacturing example 1, except that Fremantle sand is used instead of the Flattery sand. An average particle diameter of the obtained resin-coated sand 3 is 430 μm.

Examples 1 to 3

In the present examples, casting molds are each manufactured by using the apparatus shown in FIGS. 1(A) to 1(C). The forming die 2 to be used is formed of a porous material composed of permalloy (a Ni—Fe alloy including Ni in a proportion of 78.5% by mass), and its porosity is about 35%. The average pore diameter of the porous material is in a range of about 60 to 80 μm, which is smaller than the average particle diameter of the resin-coated sand 3. Prior to manufacturing each of the casting molds, the steam supply section 5 is connected to the injection hole 23 so as to feed steam in, and the forming die 2 is heated to 140 degree Celsius. Next, the resin-coated sand supply section 4 is connected to the injection hole 23 of the forming die 2 so as to supply the resin-coated sand 3 into the cavity 1 at a pressure of 0.2 MPa (FIG. 1(B)).

Next, the steam supply section is connected to the injection hole 23, and saturated steam of 144 degree Celsius is generated under a pressure of 0.4 MPa by the steam generator 50. The obtained saturated steam is heated by the heater 51 to 400 degree Celsius so as to be transformed into superheated steam, and resultant superheated steam is then supplied into the cavity 1 through the injection hole 23 (FIG. 1(C)). The superheated steam is supplied for 10 seconds (for Example 1), 20 seconds (for Example 2), and 30 seconds (for Example 3). Thereafter, each of the casting molds formed inside the cavity 1 is extracted from the forming die 2. In Examples 1 to 3, the suction pump 60 is not actuated, and the steam inside the cavity 1 is naturally discharged from the discharge holes 24.

Examples 4 to 6

Casting molds are each manufactured in the same manner as Examples 1 to 3, except that the suction pump 60, in above-described Examples 1 to 3, is connected to the discharge holes 24 of the forming die 2 via the suction tube 62, and the suction pump 60 is actuated at the same time when the superheated steam is supplied in order to suck and forcibly discharge the steam at a pressure of 0.09 MPa.

Examples 7 to 9

In the present examples, casting molds are each manufactured by using the apparatus shown in FIG. 2. The forming die 2 to be used is formed of a porous material composed of permalloy (a Ni—Fe alloy including Ni in a proportion of 78.5% by mass), and its porosity is about 50%. The average pore diameter of the porous material is in a range of about 80 to 100 μm, which is smaller than the average particle diameter of the resin-coated sand 3. Prior to manufacturing each of the casting molds, the forming die 2 is preheated, and the resin-coated sand 3 is filled into the cavity 1 at a pressure of 0.2 MPa from the resin-coated sand supply section 4 connected to the injection hole 23 of the forming die 2. Next, under the same condition as above-described Examples 1 to 3, the superheated steam is supplied into the cavity 1 from the steam supply section 5 connected to the steam supply holes 25 of the forming die 2. The superheated steam is supplied for 10 seconds (for Example 7), for 20 seconds (for Example 8), and for 30 seconds (for Example 9). Thereafter, each of the casting molds formed inside the cavity 1 is extracted from the forming die 2. It is noted that, in Examples 7 to 9, the suction pump 60 is not actuated, and the steam inside the cavity 1 is naturally discharged from the discharge holes 24.

Examples 10 to 12

Casting molds are manufactured in the same manner as Examples 7 to 9, except that the steam discharge section 6, in Examples 7 to 9, is connected to the discharge holes 24 of the forming die 2, and the suction pump 60 is actuated at the same time when the superheated steam is supplied, and the steam is forcibly discharged at a pressure of 0.09 MPa.

Examples 13 to 15

In the present examples, casting molds are each manufactured by using the apparatus shown in FIG. 3. The forming die 2 to be used is formed of a porous material composed of permalloy (a Ni—Fe alloy including Ni in a proportion of 78.5% by mass), and its porosity is about 35%. The average pore diameter of the porous material is in a range of about 60 to 80 μm, which is smaller than the average particle diameter of the resin-coated sand 3. Prior to manufacturing each of the casting molds, the forming die 2 is preheated, and the resin-coated sand 3 is filled into the cavity 1, at a pressure of 0.2 MPa, from the resin-coated sand supply section 4 connected to the injection hole 23 of the forming die 2. Next, under the same condition as above-described Examples 1 to 3, the superheated steam is supplied into the cavity 1 from the steam supply section 5 connected to the steam supply holes 25 of the forming die 2. In this case, the superheated steam is supplied for 10 seconds (for Example 13), for 20 seconds (for Example 14), and for 30 seconds (for Example 15). Thereafter, each of the casting molds formed inside the cavity 1 is extracted from the forming die 2. It is noted that, in each of Examples 13 to 15, the suction pump 60 is not actuated, and the steam inside the cavity 1 is naturally discharged from the discharge holes 24.

Examples 16 to 18

In the present examples, casting molds are each manufactured by using the apparatus shown in FIGS. 4(A) and 4(B). The forming die 2 to be used is formed of a porous material composed of permalloy (a Ni—Fe alloy including Ni in a proportion of 78.5% by mass), and its porosity is about 35%. The average pore diameter of the porous material is in a range of about 60 to 80 μm, which is smaller than the average particle diameter of the resin-coated sand 3. Prior to manufacturing each of the casting molds, the forming die 2 is preheated, and as shown in FIG. 4(A), the resin-coated sand 3 is filled into the cavity 1, at a pressure of 0.2 MPa, from the resin-coated sand supply section 4 connected to the injection hole 23 of the forming die 2. Next, as shown in FIG. 4(B), the suction pump 60 of the steam discharge section 6 is actuated in order to forcibly discharge the steam, at a pressure of 0.09 MPa, from the discharge holes 24 of the forming die 2, and, under the same condition as Examples 1 to 3, the superheated steam is supplied into the cavity 1 from the steam supply section 5 connected to the steam supply holes 25 of the forming die 2. The superheated steam is supplied for 10 seconds (for Example 16), 20 seconds (for Example 17), and 30 seconds (for Example 18). Thereafter, each of the casting molds formed inside the cavity 1 is extracted from the forming die 2.

Examples 19 to 21

In the present examples, casting molds are each manufactured by using the apparatus shown in FIG. 6. The forming die 2 to be used is formed by a porous material composed of permalloy (a Ni—Fe alloy including Ni in a proportion of 78.5% by mass), and its porosity is about 50%. The average pore diameter of the porous material is in a range of about 80 to 100 μm, which is smaller than the average particle diameter (430 μm) of the resin-coated sand 3. Prior to manufacturing each of the casting molds, the forming die 2 is preheated, and the resin-coated sand 3 is filled into the cavity 1, at a pressure of 0.2 MPa, from the resin-coated sand supply section 4 connected to the injection hole 23 of the forming die 2. Next, under the same condition as above-described Example 1 to 3, the superheated steam is supplied into the cavity 1 from the steam supply section 5 connected to the steam supply holes 25 of the forming die 2. In this case, the superheated steam is supplied for 10 seconds (for Example 19), 20 seconds (for Example 20), and 30 seconds (for Example 21). Thereafter, each of the casting molds formed inside the cavity 1 is extracted from the forming die 2. It is noted that, in Examples 19 to 21, the suction pump 60 is actuated at the same time when the superheated steam is supplied, and the steam is forcibly discharged from the cavity.

Comparative Examples 1 to 6

Casting molds are each manufactured in the same manner as Examples 1 to 6 except that an impermeable metallic die is used instead of the porous forming die 2 and that the die is heated to 140 degree Celsius by an electrical heater embedded inside the die.

In each of above described Examples 1 to 21 and Comparative examples 1 to 6, a temperature of the steam discharged from the discharge holes 24 of the forming die 2 is measured. Further, the quality of each of the obtained casting molds is evaluated in accordance with the following evaluation criteria. That is, a casting mold of good molding quality is indicated by "good", a casting mold having a partially uncured portion is indicated by "medium quality", and a casting mold which cannot be removed from the forming die and has cracks due to deficient curing is indicated by "bad". Further, a test specimen of 10 mm in height, mm in width, and 60 mm in length is extracted from each of the casting molds, and its bending strength is measured. A result thereof is shown in Table 1.

As is clear from the result shown in Table 1, each of the casting molds manufactured using the apparatus according to the present invention has a higher bending strength than each of the casting molds of the comparative examples, and also exhibits preferable quality. Further, even in the case where the steam is supplied for a shorter period of time, the temperature of the discharged steam is high, which clearly indicates that the steam is efficiently distributed throughout the resin-coated sand inside the cavity. Further, in the case where the steam is discharged forcibly, the bending strength of the casting mold tends to be higher.

TABLE 1

| | Steam supply time (sec.) | Discharged steam temperature (degrees C.) | Quality of casting mold | Bending strength of casting mold (MPa) |
|---|---|---|---|---|
| Example 1 | 10 | 121 | Good | 2.26 |
| Example 2 | 20 | 133 | Good | 2.65 |
| Example 3 | 30 | 151 | good | 3.53 |
| Example 4 | 10 | 134 | good | 2.75 |
| Example 5 | 20 | 148 | good | 3.73 |
| Example 6 | 30 | 164 | good | 4.31 |
| Example 7 | 10 | 136 | good | 2.55 |
| Example 8 | 20 | 149 | good | 3.63 |
| Example 9 | 30 | 164 | good | 4.22 |
| Example 10 | 10 | 148 | good | 3.92 |
| Example 11 | 20 | 159 | good | 4.22 |
| Example 12 | 30 | 171 | good | 4.41 |
| Example 13 | 10 | 156 | good | 4.02 |
| Example 14 | 20 | 164 | good | 4.31 |
| Example 15 | 30 | 172 | good | 4.61 |
| Example 16 | 10 | 168 | good | 4.51 |
| Example 17 | 20 | 176 | good | 4.71 |
| Example 18 | 30 | 183 | good | 4.71 |
| Example 19 | 10 | 141 | good | 2.83 |
| Example 20 | 20 | 151 | good | 3.92 |
| Example 21 | 30 | 168 | good | 4.51 |
| Comparative example 1 | 10 | 79 | bad | 0 |
| Comparative example 2 | 20 | 90 | bad | 0 |
| Comparative example 3 | 30 | 110 | medium quality | 0.98 |
| Comparative example 4 | 10 | 89 | bad | 0 |
| Comparative example 5 | 20 | 102 | medium quality | 1.47 |
| Comparative example 6 | 30 | 120 | good | 1.96 |

INDUSTRIAL APPLICABILITY

According to a casting mold manufacturing apparatus and a casting mold manufacturing method of the present invention, steam is supplied into a cavity through a porous material, whereby it is possible to manufacture a homogeneous casting mold. Accordingly, it is expected that the method for manufacturing a casting mold using resin-coated sand will become more widespread.

The invention claimed is:

1. A casting mold manufacturing apparatus comprising:

a forming die having a cavity;

a resin-coated sand supply section for supplying a resin-coated sand into the cavity, the resin-coated sand being made of a refractory aggregate coated with a binder resin;

a steam supply section for supplying steam into the cavity; and a steam discharge section for discharging the steam from the cavity, wherein at least a portion of the forming die is composed of a porous material having pores with an average diameter smaller than an average particle diameter of the resin-coated sand such that the steam is supplied into the cavity through the porous material, wherein the forming die includes:

at least one first steam supply passage for directly supplying the steam into the cavity; and at least one second steam supply passage for indirectly supplying the steam into the cavity through the porous material.

2. The casting mold manufacturing apparatus according to claim 1, wherein the second steam supply passage branches off from the first steam supply passage.

3. The casting mold manufacturing apparatus according to claim 1, wherein a porosity of the porous material is in a range of 5% to 75%.

4. The casting mold manufacturing apparatus according to claim 1, further comprising a chamber having an internal volume capable of accommodating the forming die and also having a steam supply port for causing the steam to be supplied thereinside from the steam supply section, wherein the forming die is composed of the porous material such that the steam, which is supplied, through the steam supply port, into the chamber including therein the forming die, uniformly enters into the cavity from an area surrounding the forming die through the porous material.

5. The casting mold manufacturing apparatus according to claim 1, wherein the forming die has a shield layer on an outside surface thereof so as to prevent the steam from leaking outside through the porous material.

6. The casting mold manufacturing apparatus according to claim 1, wherein the forming die has at least one steam discharge passage for discharging the steam from the cavity, and an inside surface of the steam discharge passage has a shield layer so as to prevent the steam from entering into the steam discharge passage through the porous material.

7. The casting mold manufacturing apparatus according to claim 6, further comprising: a discharge amount adjusting section provided in the steam discharge passage to adjust an amount of the steam discharged from the cavity; a temperature sensor provided adjacent to an inlet of the steam discharge passage; and a control section for controlling the discharge amount adjusting section such that a temperature detected by the temperature sensor is maintained within a predetermined temperature range.

8. The casting mold manufacturing apparatus according to claim 1, wherein the steam supply section supplies superheated steam into the cavity.

9. A casting mold manufacturing apparatus comprising:

a forming die having a cavity;

a resin-coated sand supply section for supplying a resin-coated sand into the cavity, the resin-coated sand being made of a refractory aggregate coated with a binder resin;

a steam supply section for supplying steam into the cavity; and a steam discharge section for discharging the steam from the cavity, wherein at least a portion of the forming die is composed of a porous material having pores with an average diameter smaller than an average particle diameter of the resin-coated sand such that the steam is supplied into the cavity through the porous material, wherein the forming die includes a steam supply passage for directly supplying the steam into the cavity, and an area of the forming die, the area being adjacent to an outlet of the steam supply passage and facing both of the steam supply passage and the cavity, is composed of the porous material.

10. The casting mold manufacturing apparatus according to claim 9, wherein a porosity of the porous material is in a range of 5% to 75%.

11. The casting mold manufacturing apparatus according to claim 9, further comprising a chamber having an internal volume capable of accommodating the forming die and also having a steam supply port for causing the steam to be supplied thereinside from the steam supply section, wherein the forming die is composed of the porous material such that the steam, which is supplied, through the steam supply port, into the chamber including therein the forming die, uniformly enters into the cavity from an area surrounding the forming die through the porous material.

12. The casting mold manufacturing apparatus according to claim 9, wherein the forming die has a shield layer on an outside surface thereof so as to prevent the steam from leaking outside through the porous material.

13. The casting mold manufacturing apparatus according to claim 9, wherein the forming die has at least one steam discharge passage for discharging the steam from the cavity, and an inside surface of the steam discharge passage has a shield layer so as to prevent the steam from entering into the steam discharge passage through the porous material.

14. The casting mold manufacturing apparatus according to claim 13, further comprising: a discharge amount adjusting section provided in the steam discharge passage to adjust an amount of the steam discharged from the cavity; a temperature sensor provided adjacent to an inlet of the steam discharge passage; and a control section for controlling the discharge amount adjusting section such that a temperature detected by the temperature sensor is maintained within a predetermined temperature range.

15. The casting mold manufacturing apparatus according to claim 9, wherein the steam supply section supplies superheated steam into the cavity.

* * * * *